US005570628A

United States Patent [19]

Kiener et al.

[11] Patent Number: 5,570,628

[45] Date of Patent: Nov. 5, 1996

[54] HERMETICALLY SEALED FRESH-KEEPING CONTAINER

[75] Inventors: Waldemar Kiener, Lauchheim; Herbert Schmidt, Westhausen-Lippach, both of Germany

[73] Assignee: L+H Lemiteg Lebensmittel- und Freizeittechnik GmbH, Neuhausen, Germany

[21] Appl. No.: 302,908

[22] PCT Filed: Mar. 11, 1993

[86] PCT No.: PCT/EP93/00557

§ 371 Date: Nov. 25, 1994

§ 102(e) Date: Nov. 25, 1994

[87] PCT Pub. No.: WO93/18696

PCT Pub. Date: Sep. 30, 1993

[30] Foreign Application Priority Data

Mar. 18, 1992 [DE] Germany ..... 42 08 656.6

[51] Int. Cl.[6] ..... A47J 27/00; B65D 51/16; B65D 81/20; B65B 31/04

[52] U.S. Cl. ..... 99/472; 99/467; 99/646 C

[58] Field of Search ..... 99/467, 468, 472, 99/454, 536, 494, 407, 476, 342, 330, 408–410, 403; 426/49, 311, 281; 215/260, 262, 228, 309, 311, 230; 206/524.8, 216; 220/231

[56] References Cited

U.S. PATENT DOCUMENTS

| | | | |
|---|---|---|---|
| 1,724,787 | 8/1929 | Bergeron | 99/454 |
| 2,539,999 | 1/1951 | Huzenlaub et al. | 99/536 |
| 3,396,656 | 8/1968 | Forkner | 99/494 |
| 4,051,971 | 10/1977 | Saleri et al. | 215/260 |
| 4,093,009 | 6/1978 | Iavarone et al. | 206/524.8 |
| 4,287,819 | 9/1981 | Emerit | 206/216 |
| 4,293,655 | 10/1981 | Christ et al. | 426/49 |
| 4,362,095 | 12/1982 | Wheatley | 206/524.8 |
| 5,057,332 | 10/1991 | Davidson et al. | 426/281 |
| 5,168,797 | 12/1992 | Wang | 99/342 |
| 5,195,427 | 3/1993 | Germano | 99/472 |
| 5,347,918 | 9/1994 | Chen | 99/472 |

*Primary Examiner*—Timothy F. Simone
*Attorney, Agent, or Firm*—Dvorak and Traub

[57] ABSTRACT

In an hermetically sealed fresh-keeping container for organic substances, in particular foodstuffs, with a dimensionally stable bottom part that incorporates a support surface for the goods that are to be kept fresh, a similarly dimensioned and stable upper part that is mounted on the lower part, above the support surface, so as to be removable. The hood forms a useable space, and a vacuum pump system removes the air within the useable space. The useable space is also delimited by an airproof foil, the edge of which is releasably connected with a wall of the container. A suction opening of the vacuum system is incorporated in this wall.

17 Claims, 2 Drawing Sheets

HERMETICALLY SEALED FRESH-KEEPING CONTAINER

FIELD AND BACKGROUND OF THE INVENTION

The present invention relates to an hermetically sealed fresh-keeping container for organic substances, in particular foodstuffs.

In prior art containers, the cover typically incorporates a valve through which air can be drawn out of the container by means of a hand pump.

SUMMARY OF THE INVENTION

It is the primary task of the present invention to create a freshkeeping container that is improved in comparison to the prior container. The present container is seen as an improvement, since an airproof foil is provided wherein the space in which the partial vacuum is generated, and in which partial vacuum has to be maintained, is confined to the volume that is determined by the goods to be kept fresh. This reduces the cost incurred in drawing off the air and for maintaining the partial vacuum. In addition, the walls of the container do not have to be able to withstand the relatively high pressure differential between vacuum and atmospheric. A further advantage is that cleaning the container is simplified by the foil, since this can be easily replaced.

In a preferred embodiment, the upper part of the container is in the form of a swingaway hood. This feature allows the food support surface to be easily accessible, so that no difficulties are created when goods are introduced into the container, or removed therefrom.

It is another object to utilize the entire interior space of the apparatus should this be necessary, by preferably deploying the foil in the form of a hood that is approximately matched to the swing-away hood itself.

In a preferred embodiment, the foil is adjoined to a continuous sealing strip which, when the container is closed, is clamped between the bottom portion and the upper portion of the container and is simultaneously held within a groove formed in one of the mating edge surfaces. An additional seal between the top part and the bottom part is unnecessary since this arrangement forms a hermetic seal. Since the foil has to be replaced from time to time, this also ensures that a fully functional seal is always maintained.

It is another object to provide an air evacuation system that is driven by an electric motor. This means that, in conjunction with a pressure sensor in the usable space, it is very simple to ensure keeping the contents fresh by continuously withdrawing air from the useable space, regardless of how large the volume of the useable space may be.

It is preferred that the air pump system be arranged beneath the food support surface and that a food particle separator be inserted between the outlet opening through which the air is drawn off, and the air pump.

It is still another object of the present invention to be able to remove the foil from the goods in order to easily retrieve the goods without destroying the foil. This is accomplished by drawing the air out from the intermediate space between the foil and the hood by means of the same air pump system. In a preferred embodiment, the air pump system incorporates a monostable two-way valve which has a first position that opens a first suction line connecting the pump with the usable space while closing a second suction line that connects the pump to the intermediate space. In a second valve position, the first suction line is closed and the second suction line is open.

It is also envisioned to provide a control device for the pump motor and a solenoid connected to the two-way valve, wherein a pressure switch activates the pump if the pressure in the useable space is too high, and which turns the pump off if the partial vacuum in the useable space reaches a specified value. The control device not only ensures that proper quantity of air is continuously drawn off from the useable space once the goods have been placed in the container, it is also ensures that in the case of a leak, the pump is temporarily activated so as to continuously maintain the partial vacuum in the useable space. Warning lights can also be used to indicate whether the container is operating properly or whether, as a result of a fault, the useable space has not been sufficiently evacuated. The pressure sensor is similarly used to control these warning lamps.

In a preferred embodiment, a second pressure switch can be connected in series with the first switch and used for detecting whether the container is open or properly closed.

BRIEF DESCRIPTION OF THE DRAWINGS

The present invention will be described in greater detail in conjunction with the drawings which are appended hereto. These drawings show the following.

DESCRIPTION OF THE PREFERRED EMBODIMENTS

Figure 1:
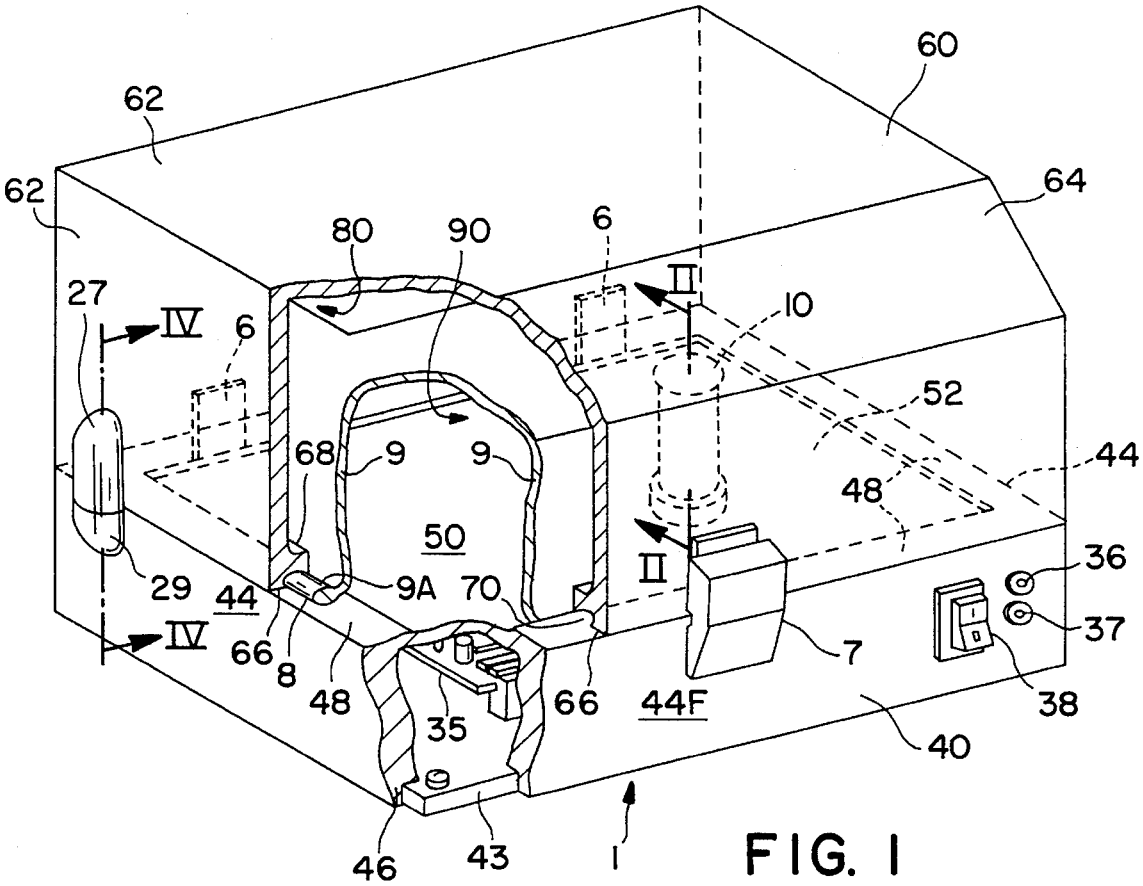
FIG. 1 is a partial cut away perspective view of the exemplary preferred * embodiment of the present invention.

An hermetically sealable fresh-keeping container 1 for organic substances, in particularly foodstuffs, the exemplary embodiment of which is preferably in the form of a square, has as is shown in FIG. 1, a bottom part 40 and, as the top part, a hood 60, both of these parts of substantially equal dimensions and being made of plastic. A clear plastic can also be used for the hood.

The bottom part 40 incorporates a flat base plate 43 that is releasably connected to the bottom 46 of side walls 44. Slightly below the top edge surface 48 of each of the side walls 44 is a flat plate 50, which is parallel to the base plate 43, and which the upper side forms a support surface 52 for the goods that are to be kept fresh.

The side walls 62 of the hood 2, whose form in the exemplary embodiment differs from the form of a square only by an inclined surface 64 at the transition from the top to the front, include side wall bottom surfaces 66 which lie on the edge surfaces 48 of the side walls 44 of the bottom part 40. Two hinges 6 link the bottom part 40 and the hood 60 at the back, and all that is required to open the container is to lift the hood 60 up and toward the back and to lower it forward in order to close the container. For this reason, the user need not be concerned as to whether the hood 60 has been correctly positioned when being closed. The hinges 6 ensure correct positioning. At the middle of the front side of the container, there is a snap catch 7 whose closing element overlaps a lug (not shown) that is formed on the hood 60 for drawing the front wall of the hood 2 against the top edge surface 48 of the front wall of the lower part 40. Latch 7 ensures that all of the edge surfaces 66 of the hood 60 are pressed with sufficient force against the edge surfaces 48 of the bottom part 40.

As is shown in FIG. 1, the side walls 62 of the hood 60 have a flange section 68 that extends along their lower edge 66, by which the edge surface that is formed here (66) is matched to the width of the edge surface 48. This wider edge surface of the side walls of the hood 60 is provided with an encircling groove 70 that is open towards the edge surface 98 and in which a sealing strip 8 can be installed. The dimensions of the groove 70 and of the sealing strip 8 are so selected so that when the hood 2 is closed, the sealing strip 8 is pressed into the walls of the groove and also onto the edge surface 48 in order to hermetically seal the hood 60 closed. The edge 9A of an airproof foil 9 is formed as part of the sealing strip 8, and when the foil 9 is deployed it, is of a shape that is matched to the shape and size of the hood 60. The sealing strip 8 that is clamped tightly in the groove 70 need only be withdrawn from the groove in order to clean the foil 9 or replace it. Only the sealing strip 8 of a cleaned or new foil 9 need be installed in the groove 70 in order to bring the foil 9 into position within the hood 60 that is shown in FIG. 1.

Figure 2:
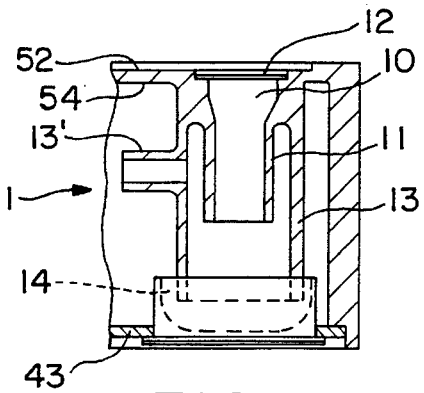
FIG. 2 is a cross-section view taken along line II—II in FIG. 1.

Because of the fact that the useable space, i.e., the space that is available for the goods that are to be kept fresh, is defined by the support surface 52 and, by the foil 9, an air suction channel 10 opens out into the support surface 52. As is shown in FIG. 2, the pipe 11 that defines the air suction channel 10, is formed as part of the lower or underside surface 54 of the panel 50 that forms the support surface 52. A removable screen 12 covers the opening of the air suction channel 10.

Like the pipe 11, a tube 13 which is of larger diameter, is arranged concentrically within the pipe 11 and is integrally formed on its one end with pipe 11 and underside surface 54. The other end of the tube 13 that is remote from the base plate 43 is located in a cupshaped collector 14 that is inserted from below container 1, into an opening in the base plate 43 so as to be removably clamped therein and, if its contents are to be emptied out, this can be withdrawn downward. Above the lower end of the pipe 11 there is a connector stub 13' on one side of the tube 13 and this is used to connect with a first suction line 15. The elements 11 and 13 thus form a siphon-like particle separator, in which particles not trapped by the mesh 12 are separated from the air that is drawn off. These particles then fall into the collector 14.

Figure 3:
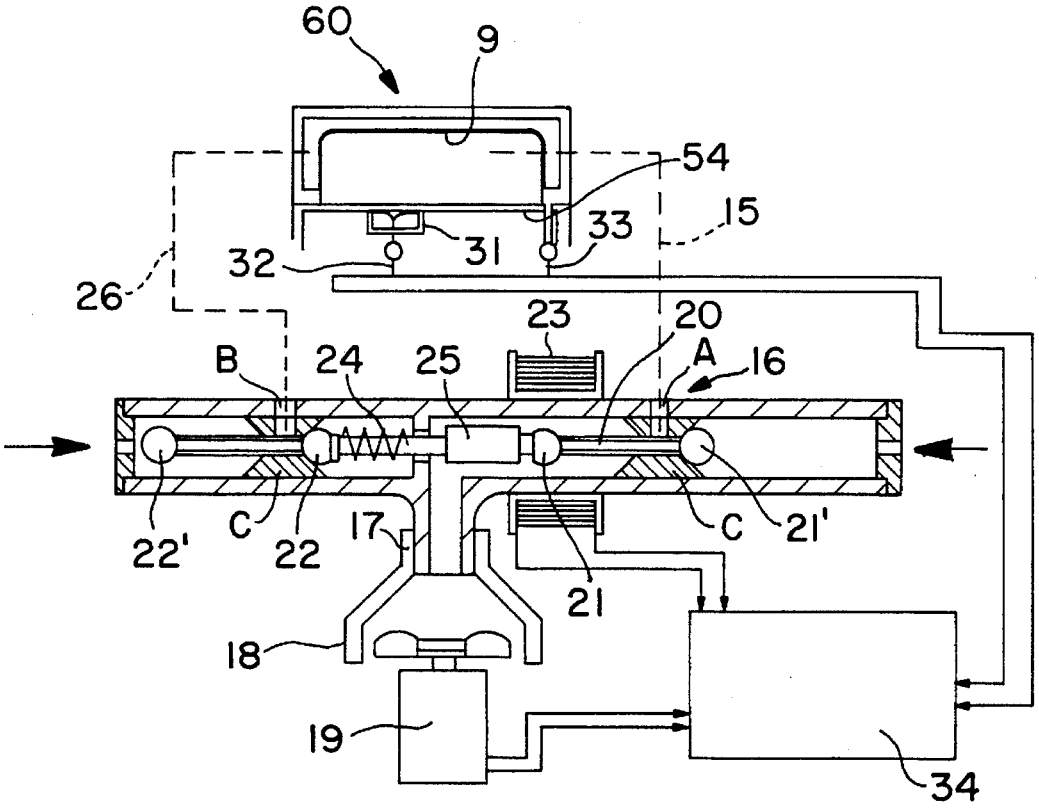
FIG. 3 is a line diagram of the preferred embodiment, with a cross-section taken through the two-way valve of the air pump system.

As is shown in FIG. 3, the first suction line 15 leads to the first connector "A" of a monostable two-way valve 16. A normally open valve channel leads from this connector to a pump connector 17. A normally closed valve channel leads from a second connector "B" to the pump connector 17. Connector 17 is shown directly connected with the suction side connector of a pump 18 that is driven by an electric motor 19. As is shown in FIG. 3, the two-way valve 16 has a common longitudinally moveable valve-actuating rod 20 for the two valves that are arranged in one or more vertical channels, and this valve-actuating rod 20 supports the one valve body 21 of the one valve and a valve body 22 of the other valve, by means of which the valve channel leading to the first connector A or the valve channel leading to the second connector B can be opened and closed alternately. In order to move the two-way valve 16 from the normal position that is shown in FIG. 3 into the other position in which air is drawn from the intermediate space 80 between the foil 9 and the inner surface of the hood 60, the valve actuating rod 20 is moved to the right when viewed as in FIG. 3, against the force of a biasing spring 24, by means of a solenoid 23. A cylindrical magnetic flux conductor (not shown) is arranged on the valve-actuating rod 20 is located in the interior of the solenoid 23. The guide surfaces C of the valve housing for the valve-actuating rod 20 or, as in the example, those of the valve-actuating rod 20 are formed as longitudinal ribs, between which the air can pass along the valve-actuating rod 20.

The second connector of the two-way valve 16 is connected through a second suction line 26 to the intermediate space 80 between the foil 9 and the inside surface of the hood 2 in order to raise the foil 9 from the goods that are being kept fresh and to push the foil 9 against the inside of the hood 60 before it is opened.

In order that air can flow into the intermediate space 80 between the foil 9 and the hood 60, when the air is drawn out of the usable space 90 between the foil 9 and the support surface 52, even though the valve body 22 is lying tightly on its valve seat, a ventilation channel leads from the second connector to an air inlet opening of the two-way valve 16 that is fitted at the left-hand end (as in FIG. 3) of the valve housing. When the valve 16 is actuated, this ventilation channel is closed by a valve body 22' that is also located on the valve-actuating rod 20. If the two-way valve 16 is actuated, then the first connector is connected through a ventilation channel to an air inlet opening of the two-way valve 16 that is at the right-hand (as in FIG. 3) end of the valve housing. There is also a valve body 21' on the valve-actuating rod 20 in this ventilation channel, and when the valve is not actuated this lies tightly on its valve seat, and when the valve is actuated, it is raised from its seat and thus opens the ventilation channel.

Figure 4:
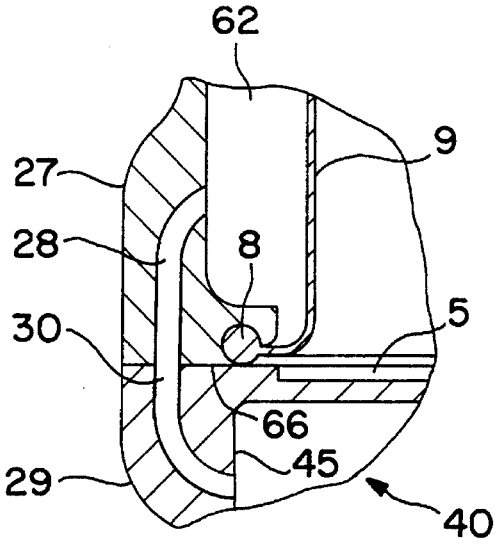
FIG. 4 is a cross-section view taken along line IV—IV in FIG. 1.

Since the two-way valve 16 is located below the support surface 52, as shown in FIGS. 1 and 4, a bubble 27 is formed on the side wall 62 of the hood 60 on the left-hand side in order to cover a first connector channel 28 formed through the side wall 62. Channel 28 has one end open to intermediate space 40 and the other open to the bottom edge 66 of wall 62, that is widened at this point. A second bubble 29 is also formed on the lower part 40 and is aligned with the bubble 27, and this second bubble 29 incorporates a second connector channel 30. When the hood 60 is closed, one end of second channel 30 communicates with the first connector channel 28 and the other end opens to the inside surface 45 of the side wall 44 of the bottom part 43, where the second suction line 26 (not shown in FIG. 4) is connected.

Shown only in FIG. 3 is a pressure sensor 31 that is mounted on the underside 54 of the plate 50 that forms the support surface 52. Sensor 31 incorporates a membrane which the pressure in the useable space 90 acts directly upon. The pressure sensor 31 operates a microswitch 32 such that the microswitch is closed when air has to be drawn from the useable space 90 and is opened when the partial vacuum in the useable space 90 has reached the desired value.

A second microswitch 33, is actuated by a push rod (not shown) connected in series with the first microswitch 32, which keeps the second microswitch 33 open if the snap catch 7 is opened, and closed when the snap catch 7 is closed.

The two microswitches 32 and 33 are connected to a control unit 34, comprised of a circuit board 35 that is arranged therein. Unit 34 is mounted beneath the plate 50 of the bottom part 43. The electric motor 19, the solenoid 23, and two warning lights 36 and 37 (located in the front wall 44F), are similarly connected to the control unit 34; when activated, these signal lights display a green or a red light, respectively. The green light (36) indicates that the desired partial vacuum is present in the useable space 90, in contrast to which the red light (37) indicates a fault. A power switch 38 is fitted in the front wall 44F and is connected to the control unit 34 in order to power unit 34.

When the hood 60 is closed, and switch 38 is turned on, and if the snap catch 7 is open, the microswitch 33 is moved to the switch position "Hood Open." As a result, the control unit 34 switches the electric motor 19 on for a specified time and during this time activates the solenoid 23 so that the air is drawn out from the intermediate space 80, between the foil 9 and the hood 2 and air can flow into the useable space 90 between the foil 9 and the support surface 52. This means that the foil 9 is maintained in its completely deployed state. The hood 60 is now opened and the goods that are to be kept fresh, which can be for example, bread, rolls, sausages, cookies, salad, vegetables, etc. are laid on the support surface 52. Then the hood 60 and the snap catch 7 are closed once again. The microswitch 33 moves into the closed position that is shown in FIG. 3. This also applies to the microswitch 32 because the useable space 90 is still under atmospheric pressure. The two-way valve 16 remains in the position that is shown in FIG. 3 and the electric motor 19 is switched on. Then, air is now withdrawn from the useable space 90. When this is done, the foil 9 collapses about the goods that are to be kept fresh, which means that air can freely flow into the intermediate space 80 between the foil 9 and the hood 60. Once the desired partial vacuum has been achieved in space 90, the microswitch 32 opens and the electric motor is switched off. Then, the green warning light 36, which can be a light-emitting diode, is switched on.

Should air enter the useable space 90, this leads to a rise in pressure that is detected by the pressure sensor 31. The electric motor 19 is once again switched on for long enough period to ensure that the desired partial vacuum is once again established. This ensures that the required partial vacuum is maintained automatically in the useable space 90. Only when the snap catch 7 is opened is the two-way valve 16 repositioned for a specific time, wherein the electric motor 19 is switched on so that the foil 9 can be refilled and lifted away from the goods that are to be kept fresh and then pushed against the inside of the hood 60.

All of the features discussed in the above description, as well as those that are shown in the drawings, are components of the present invention, as well as additional modifications embodied by the claims.

We claim:

1. A hermetically sealable fresh-keeping container for organic goods such as foodstuffs, said container comprising:

a bottom part that includes at least one wall, and a support surface attached to said wall for holding the goods that are to be kept fresh, said support surface including a hole therethrough;

a top part dimensionally similar to said lower part and removably positioned on top of the bottom part whereby said container is openable and closable, thereby forming a useable space above the support surface, said space containing air when said upper part is initially positioned on top of said bottom part, said walls of said bottom part having a top edge surface, and said walls of said top part having a bottom edge surface;

an air pump system for removing the air within the useable space; and an airproof foil delimited by the useable space, said foil having an edge which is hermetically and releasably connected to said wall of said bottom part, said support wall including a suction opening therethrough, said opening communicating between said air pump apparatus and said useable space.

2. A container as defined in claim 1, wherein the upper part is configured as a hood having a physical size defined by said lower part.

3. A container as defined in claim 2, wherein the foil is of a shape and a size that approximates that of the hood.

4. A container as defined in claim 3 wherein the foil incorporates a sealing strip along said edge such that said sealing strip is clamped between bottom edge surface of said top part and top edge surface of said bottom part when said container is closed.

5. A container as defined in claim 4 wherein the bottom edge surface of each of said walls of the top part is provided with an encircling groove, said groove receiving said sealing strip therein.

6. A container as defined in claim 5, wherein said top part is connected by at least one hinge to the bottom part.

7. A container as defined in claim 6 wherein said top part can be held in a hermetically sealed position on the top edge of said bottom part by at least one closing device.

8. A container as defined in claim 7 wherein the support surface is formed by a horizontally disposed, one-piece plate that is hermetically connected above the bottom of the bottom part to the side wall thereof and is preferably formed in one piece.

9. A container as defined in claim 8 further including a first connector channel formed in said side wall of said top part, and a second connector channel formed in said side wall of said bottom part, each of said channels having respective pairs of ends, said first channel having one end open to said intermediate space and said other end open to said bottom edge surface, said second channel having one end connected to said air pump system and said other end open to said top edge surfaces, each of said channels in vertical alignment to each other when said container is closed.

10. A container as defined in claim 9 wherein the bottom part has a space between the support surface and said base plate, the air pump system accommodated in the said space and resting on said base plate.

11. A container as defined in claim 10, further including a vertically disposed air suction channel, said channel defined by a pipe having an upper end coextensive with said support surface and a lower end disposed within a concentrically arranged tube, said pipe extending from above said base plate up to and through said support surface, said pipe in communication with said useable space, wherein said tube includes a side interconnecting a pair of ends, one end of said tube integrally terminating with said flat plate and another end located in a removable collector, said tube side including a horizontally disposed connector stub extending therefrom, said stub disposed near said pipe lower end and having an unconnected end for attachment to said air pump system, said pipe, said tube, and said stub operably forming a food particle separator wherein said air from said useable space is withdrawn therefrom in said air pump and passes downwardly through said air suction channel, and any food particles entrained with said withdrawn air fill into said collector while said air exits said tube and said collector stub.

12. A container as defined in claim 11, wherein the air pump system incorporates a monostable two-way valve, said valve having two connections, one connection connects a first suction line from the pump to the connection stub and the other connection connects a second suction line to the suction channel.

13. A container as defined in claim 12 further including a control device for controlling an electric motor that drives the pump, and a solenoid that actuates the two-way valve.

14. A container as defined in claim 13, further including a pressure sensor switch connected to the control device, said switch switches off the pump when a partial vacuum within the useable space has reached a prescribed value.

15. A container as defined in claim 14, further including warning lights that are controlled by the pressure sensor switch.

16. A container as defined in claim 14, further including a second pressure sensor switch connected to the control device, the second switch determining whether the container has been properly or improperly closed.

17. A container as defined in claim 16 further including a second pressure sensor switch connected to the control device, the second switch determining whether the container has been properly or improperly closed.

* * * * *